US012560390B2

(12) United States Patent
Brandt et al.

(10) Patent No.: US 12,560,390 B2
(45) Date of Patent: Feb. 24, 2026

(54) GREY WATER HEAT RECOVERY APPARATUS

(71) Applicant: Consat AB, Partille (SE)

(72) Inventors: Emil Brandt, Alingsås (SE); Ian Hostetter, Mölndal (SE); Martin Hogander, Surte (SE)

(73) Assignee: CONSAT AB, Partille (SE)

( * ) Notice: Subject to any disclaimer, the term of this patent is extended or adjusted under 35 U.S.C. 154(b) by 41 days.

(21) Appl. No.: 18/571,414

(22) PCT Filed: Jun. 27, 2022

(86) PCT No.: PCT/EP2022/067512
§ 371 (c)(1),
(2) Date: Dec. 18, 2023

(87) PCT Pub. No.: WO2023/274927
PCT Pub. Date: Jan. 5, 2023

(65) Prior Publication Data

US 2024/0280331 A1 Aug. 22, 2024

(30) Foreign Application Priority Data

Jun. 30, 2021 (EP) ..... 21182983

(51) Int. Cl.
*F28D 21/00* (2006.01)
*F28D 7/10* (2006.01)
(Continued)

(52) U.S. Cl.
CPC ..... *F28D 21/0012* (2013.01); *F28D 7/103* (2013.01); *F28F 13/12* (2013.01); *E03C 2001/005* (2013.01)

(58) Field of Classification Search
CPC . F28D 7/10; F28D 7/103; F28D 7/106; F28D 21/0012; F28F 13/12; E03C 2001/005
See application file for complete search history.

(56) References Cited

U.S. PATENT DOCUMENTS 5,816,322 A * 10/1998 Albano ..... F28D 7/106 165/173
8,991,871 B2 3/2015 Weinhold
(Continued)

FOREIGN PATENT DOCUMENTS

CN 2535591 Y * 2/2003
DE 202006001996 U1 6/2006
(Continued)

*Primary Examiner* — Eric S Ruppert
(74) *Attorney, Agent, or Firm* — Panitch Schwarze Belisario & Nadel LLP

(57) ABSTRACT

A grey water heat recovery apparatus is disclosed in which heat is transferred between a grey water stream and a fresh water stream. The apparatus comprises: a grey water flow path leading from a source inlet to a drain outlet; a plurality of heat exchangers arranged in said grey water flow path; a separator arranged upstream of said heat exchangers, arranged to separate grey water from the source inlet into a plurality of parallel sub-paths, each sub-path being lead to one of the heat exchangers; and a collector arranged downstream of said heat exchangers, arranged to reassemble the grey water from the sub-paths into a single flow path. Each heat exchanger comprises a grey water tube extending from the separator to the collector, and an outer tube surrounding at least a part of the grey water tube, the outer tube defining an annular space around the grey water tube. A fresh water flow path formed within the annular spaces around the grey water tubes in the heat exchangers has a flow direction being opposite to the flow direction of the grey water.

16 Claims, 6 Drawing Sheets

(51) Int. Cl.
*F28F 13/12* (2006.01)
*E03C 1/00* (2006.01)

(56) References Cited

U.S. PATENT DOCUMENTS

| | | | | |
|---|---|---|---|---|
| 2001/0020786 | A1* | 9/2001 | Takamatsu | F28F 9/02 285/123.1 |
| 2012/0318483 | A1* | 12/2012 | Cosby | F28D 21/0012 165/154 |
| 2015/0130183 | A1 | 5/2015 | Statler, III et al. | |
| 2018/0187980 | A1 | 7/2018 | Gil et al. | |
| 2020/0109862 | A1* | 4/2020 | Helfers | F28D 7/0008 |

FOREIGN PATENT DOCUMENTS

| | | | | | |
|---|---|---|---|---|---|
| EP | 2345851 | A2 | | 7/2011 | |
| JP | S63259387 | A | * | 10/1988 | |
| NL | 1028249 | C2 | * | 8/2006 | F28D 21/0012 |
| NL | 2020757 | B1 | | 10/2019 | |
| SU | 556303 | A | * | 3/1975 | |
| WO | 2011127574 | A1 | | 10/2011 | |
| WO | 2015043548 | A1 | | 4/2015 | |

* cited by examiner

GREY WATER HEAT RECOVERY APPARATUS

CROSS-REFERENCE TO RELATED APPLICATIONS

This application is a § 371 national phase entry of International Application No. PCT/EP2022/067512, filed Jun. 27, 2022, which claims priority to European Patent Application Ser. No. 21/182,983.3, filed Jun. 30, 2021.

TECHNICAL FIELD OF THE INVENTION

The present invention relates to a grey water heat recovery apparatus.

BACKGROUND

Heat exchangers for use in household shower and bath systems are known, e.g. from US 2012/0318483, WO 2011/127574 and US 2018/0187980. Such heat exchangers may be used to recover heat from grey water in private homes and the like. However, these heat exchangers are not useable for large volumes of grey water, and are consequently not useable in e.g. sport facilities, swim houses, apartment buildings, etc.

Further, the heat recovery efficiency is relatively low in most known grey water heat recovery apparatuses.

There is therefore a need for a grey water heat recovery apparatus which has great heat recovery efficiency, and which can be used also for high flow rates and large volumes of grey water.

SUMMARY OF THE INVENTION

It is therefore an object of the present invention to provide a grey water heat recovery apparatus which at least alleviates the above-discussed problems.

This object is obtained by means of a grey water heat recovery apparatus in accordance with the appended claims.

According to a first aspect of the present invention there is provided a grey water heat recovery apparatus in which heat is transferred between a grey water stream and a fresh water stream, wherein the apparatus comprises:

- a grey water flow path leading from a source inlet to a drain outlet;
- a plurality of heat exchangers arranged in said grey water flow path;
- a separator arranged upstream of said heat exchangers, arranged to separate grey water from the source inlet into a plurality of parallel sub-paths, each sub-path being lead to one of said plurality of heat exchangers;
- a collector arranged downstream of said heat exchangers, arranged to reassemble the grey water from the sub-paths into a single flow path;
- wherein each heat exchanger comprises a grey water tube extending from the separator to the collector, and an outer tube surrounding at least a part of the grey water tube, the outer tube defining an annular space around the grey water tube; and
- a fresh water flow path formed within the annular spaces around the grey water tubes in said heat exchangers in a flow direction being opposite to the flow direction of the grey water.

The grey water heat recovery apparatus is very efficient, with a very high degree of heat recovery. The great efficiency and large capacity is at least partly due to the separation of the grey water into a plurality of sub-paths. The apparatus may e.g. be used in sport facilities, apartment buildings and the like to recover heat from showers, etc. In an exemplary embodiment, the showers may be provided with hot water of 55 deg. C. The shower water may have a temperature of about 39 deg. C. The grey water from the showers may then have a temperature of about 33 deg. C. when reaching the heat recovery apparatus. Cold water at a temperature of about 7 deg. C. may be provided to the heat exchangers. The temperature of the cold water when heated in the heat exchangers will vary depending on the flow rate of the cold water. If the flow rate of the cold water is essentially the same as the flow rate of the grey water, the cold water will be heated to a temperature of at least about 24 deg. C., which corresponds to a heat recovery of about 65-70%. At a higher flow rate of the cold water, such as with a flow rate of the cold water being essentially twice the flow rate of the grey water, the cold water will be heated to a temperature of about 18 deg. C., which corresponds to a heat recovery of about 90%. The great heat recovery is at least partly due to the separation of the grey water into a plurality of sub-paths, providing an enlarged heat recovery area between the grey water and the cold water.

The heat recovery apparatus is further cost-efficient to produce and relatively compact and space efficient.

The heat recovery apparatus is further easy to inspect, clean and repair.

The heat recovery apparatus is particularly suited for relatively high flow rates of drain water, such as found e.g. in public sport facilities, public baths, public swimming facilities, etc. However, the heat recovery apparatus may also be made with smaller dimensions, for use in apartment buildings, in private houses and the like.

Grey water, as used in the present application, refers to wastewater generated in households, office buildings, industries, public facilities and the like, and which is without fecal contamination, i.e. all streams of wastewater except for the wastewater from toilets. Sources of grey water include sinks, showers, baths, washing machines and dishwashers.

The grey water flow path is preferably gravity feed, i.e. where gravity generates the flow, without the need of any pumps or the like. However, for certain applications, it is also feasible to provide one or more pumps to generate the grey water flow path.

The separator preferably comprises a separator inlet leading into a plurality of vortex generating outlets connected to said sub-paths. In an embodiment, the separator inlet is centrally arranged in the separator, and wherein the vortex generating outlets are arranged distributed, and preferably evenly distributed, around said separator inlet. The number of vortex generating outlets corresponds to the number of sub-paths. In a preferred embodiment, the number of sub-paths is more than 2, such as at least three, at least 5, at least 7 or even 10 or more. The number of sub-paths, and heat exchangers, may be in the range of 3-15, and preferably 5-12, and most preferably 7-10.

The vortex generating outlets may comprise an inlet channel and a circular cup centered around the outlet connected to the sub-paths, wherein the channel debouches off-center into the circular cup. The channel may e.g. debouche close to the rim of the circular cup. Preferably, the channel debouches in a direction essentially tangential with a wall of the circular cup.

Due to the vortex generating outlets, the grey water entering into the heat exchangers will not only have a longitudinal flow, but also a rotational flow around said longitudinal direction. Hereby, this will create turbulence and a greater exposure of the grey water to the walls of the heat exchangers, which increases the heat recovery efficiency.

The annular space around each grey water tube preferably extends essentially over the entire length of the grey water tube, from the separator to the collector. This increases the contact area and makes the heat recovery more efficient.

In a preferred embodiment, the grey water tubes extend in a generally vertical direction. Thus, the grey water is moved downwardly through the grey water tubes.

The heat recovery apparatus may further comprise a grey water feeding tube extending from a position in the vicinity of the collector to the separator. Hereby, the grey water may e.g. be lead first to a position close to the collector, and then up through the grey water feeding tube, be separated by the separator into the different heat exchangers, moved downwardly through the heat exchangers, and then be rejoined in the collector. In an embodiment, the grey water feeding tube is arranged centrally within the plurality of heat exchangers, with the plurality of heat exchangers preferably being arranged evenly distributed around the grey water feeding tube. The provision of the grey water feeding tube enables a very controllable feeding of grey water into the heat exchangers. It also allows the apparatus to be cleaned and inspected in a relatively simple fashion. Since the grey water preferably flows upwardly through the grey water feeding tube, particles and other solid or semi-solid waste in the grey water will, at least to some extent, sediment to the bottom of the grey water feeding tube, where it can easily be removed from time to time. To this end, an openable valve may e.g. be arranged in the grey water feeding tube at a position in the vicinity of the collector. The openable valve may e.g. be in the form of a gate valve or sluice valve, that opens by lifting a barrier, gate, out of the path of the fluid. The gate may have a uniform thickness, but is preferably wedge shaped. By opening the valve, the liquid in the grey water feeding tube, above the valve, will due to gravity flow downwardly through the valve, thereby bringing along all the solid and semi-solid waste that may have assembled at the bottom of the grey water feeding tube. Thus, cleaning becomes very simple, since it only involves opening of the valve from time to time, such as periodically, at given time intervals, or when a sensor or the like detects a need for cleaning. The valve can be a manually operated valve, or an automatic- or semi-automatic valve, e.g. controlled by a controller.

The grey water feeding tube may also comprise a sieve, arranged e.g. close to the collector, or at an intermediate position between the collector and the separator. The sieve will also be cleaned as grey water is flowing downwards when the valve is opened.

Inspection can also be made from below, through the valve, or at other positions, such as from above, at the separator, from the bottom, at the collector, or the like. The sieve may e.g. comprise a mesh, such as a wire mesh, or a plate with perforations, e.g. made of metal or plastic material.

The heat exchangers comprise grey water tubes extending from the separator to the collector, and outer tubes surrounding at least a part of the grey water tubes, the outer tube defining an annular space around the grey water tube. The tubes are preferably concentrically arranged, forming a double wall tube. The wall of the grey water tube forms a separation between the grey water and the fresh water, thereby prohibiting contact between the grey water and the fresh water. The wall of the grey water tube is preferably made of a material with high thermal conductivity. In a preferred embodiment, the wall of the grey water tube is made of copper. However, in order to make the material less sensitive to chemicals, such as chloride, that may be present in the grey water and/or the fresh water, the wall material may be coated, e.g. with chrome, to be more resistant. In a preferred embodiment, such a coating is provided on both sides of the wall, i.e. both towards the grey water and towards the fresh water. However, in alternative embodiments, such a coating may be provided only at one side, such as towards the grey water.

In an embodiment, the wall of the grey water tube may be provided with inward protrusions, extending in towards either the grey water or the fresh water, or both, and e.g. in the form of baffles. The inward protrusions/baffles only extend partly into the cavity, and do not extend into the other side of the tube. Thus, the inward protrusions/baffles do not stop the grey water and/or fresh water in any direction, and still allows it to flow generally in an axial, longitudinal direction, but at the same time increase the turbulence as the grey water and/or fresh water flows over the inward protrusions/baffles.

The inward protrusions/baffles may extend generally in a radial direction, e.g. as circles extending around the wall. However, the inward protrusions/baffles may also be arranged in a helical form, such as in the form of threads.

The increased turbulence in the grey water and/or the fresh water makes the heat transfer to the fresh water more efficient, and consequently increases the heat recovery efficiency. The increased turbulence disrupts the boundary layer and encourage mixing of the flow so that a greater volume of the flow comes into direct contact with the wall, for optimal heat transfer efficiency.

At one or both of the sides, and in particular on the side towards the fresh water, inward protrusions may also be provided in the form of one or more wire(s), e.g. arranged in a helical path, as a thread, and extending into the cavity where the fresh water, or grey water, flows.

The wires only extend partly into the cavity, and do not extend into the other side of the tube. Thus, the wires do also not stop the grey water and/or fresh water in any direction, and still allows it to flow generally in an axial, longitudinal direction, but at the same time increase the turbulence as the grey water and/or fresh water flows over the wire.

The wire(s) may extend generally in a radial direction, e.g. as circles extending around the wall. However, the wire(s) may also be arranged in a helical form, such as in the form of threads. In a preferred embodiment, at least two wires, and preferably at least three wires, are arranged in corresponding, parallel, helical shapes. In embodiments, 4, 5 or 6 wires may also be used. The number of wires is preferably not more than 7. Hereby, the same effect of generated turbulence can be achieved, but with a higher pitch for the threads. This is particularly of advantage when e.g. combined with the above discussed baffles, since it alleviates the problem of the wires sinking into the baffles.

As an alternative to the wires, baffles or the like may be used on both sides of the tube.

The increased turbulence in the grey water and/or the fresh water makes the heat transfer to the fresh water more efficient, and consequently increases the heat recovery efficiency.

The heat exchangers may further comprise an inner tube, arranged inside the grey water tube, the intermediate space formed between the inner tube and the grey water tube forming the grey water sub-path. Thus, in this embodiment, the heat exchanger may comprise three concentrically arranged walls—an outer wall and an intermediate wall forming the annular cavity for leading the fresh water, and the intermediate wall and an inner wall forming another, interior annular cavity for leading the grey water. The inner cavity, formed inside the inner wall, may be empty, or may alternatively be filled with an insulating material or the like. The provision of an annular cavity for both the fresh water and the grey water increases the exposure and heat transfer, and thereby increases the heat recovery efficiency.

The heat exchangers are preferably relatively long, such as having a length in the range of 1-5 m, and preferably in the range of 2-4 m. The length is preferably adapted to the height of the room in which the heat exchangers are arranged. On the other hand, the heat exchangers are preferably as long as possible, thereby increasing the heat recovery efficiency. When long heat exchangers are used, each heat exchanger may be formed by at least two sections, the sections being connected together by a connection device enabling flow for both the grey water and the fresh water. The connection device may e.g. form a connection between the inner tube wall(s), thereby allowing a flow through the inner tube, or the inner annular cavity. The outer annular cavities may be closed by the connection device, and instead connected together by a bypass connection. Such connection devices are per se known e.g. from US 2015/0130183 and U.S. Pat. No. 8,991,871, said documents hereby being incorporated by reference in their entirety. Forming of heat exchangers as separate, connectable sections facilitates manufacturing, and e.g. makes it easier and less costly to arrange a layer of metal, such as nickel, on the inside.

The heat recovery apparatus may be used together with other heat recovery apparatuses of the same type in a heat recovery system comprising a plurality of such heat recovery apparatuses. The system may e.g. comprise 2, 3, 4, 5 or even more heat recovery apparatuses. The heat recovery apparatuses are preferably arranged in parallel, allowing the flow of grey water first to be separated between the different heat recovery apparatuses, and then, as discussed in the forgoing, be separated between the different heat exchangers within each heat recovery apparatus. This increases the heat recovery efficiency even further, in particular when the flow rate and volume of grey water is high. The heat recovery apparatuses arranged for a parallel flow may be arranged along a line, but may also be arranged in a triangle, rectangle, or the like.

The grey water heat recovery apparatus as discussed above can recover heat from the hot water used in showers, bathtubs, sinks, dishwashers, washing machines, etc. Hereby, heat is transferred from the hot grey water to the cold fresh water. The thereby heated fresh water may be used as hot water for the showers and the like, and thereby reducing the energy needed for heating of the fresh water into hot water. Thus, e.g. when used in sport facilities, swim houses and the like, where there is a nearly constant need of hot water, the fresh water heated by the grey water heat recovery apparatus(es) may be used immediately as part of the water heated to hot water. However, in installations and applications where hot water is used less frequently, such as periodically or intermittently, the heated fresh water may also be stored in a tank or reservoir, arranged to maintain the heat in the heated fresh water for a period of time.

These and other aspects of the invention will be apparent from and elucidated with reference to the embodiments described hereinafter.

BRIEF DESCRIPTION OF THE DRAWINGS

For exemplifying purposes, the invention will be described in closer detail in the following with reference to embodiments thereof illustrated in the attached drawings, wherein:

FIGS. 2*a-d* are more detailed illustrations of a grey water heat recovery apparatus in accordance with an embodiment of the present invention, wherein FIG. 2*a* is a side view, partly in cross-section, of the entire grey water heat recovery apparatus, and FIGS. 2*b-d* are close up illustrations of the upper part, lower part and intermediate part, respectively, of the grey water heat recovery apparatus of FIG. 2*a;*

FIG. 3*a* is a cross-section in a horizontal plane and FIG. 3*b* is a cross-section in a vertical plane;

DETAILED DESCRIPTION OF PREFERRED EMBODIMENTS

Figure 1:
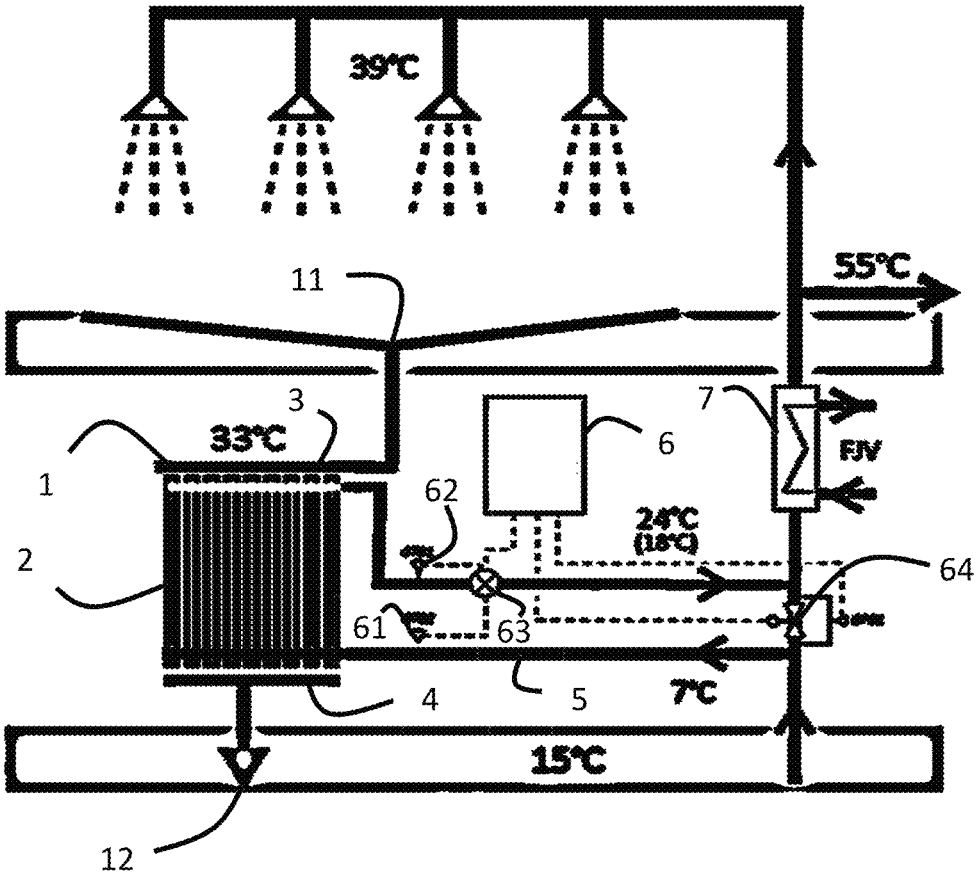
FIG. 1 is a schematic illustration of a heat recovery system using a grey water heat recovery apparatus in accordance with an embodiment of the present invention.

In the following detailed description preferred embodiments of the invention embodiments are exchangeable between the embodiments and may be combined in different ways, unless anything else is specifically indicated. It may also be noted that, for the sake of clarity, the dimensions of certain components illustrated in the drawings may differ from the corresponding dimensions in real-life implementations of the invention.

An embodiment of a heat recovery apparatus is schematically illustrated in FIG. 1. The heat recovery apparatus may e.g. be used in a swim house, a sport facility or the like, e.g. to recover energy from the grey water coming from the showers. In this embodiment, grey water is assembled from the sources, such as the drains of the showers, and is lead through a grey water flow path 1 leading from the source inlet 11 to a drain outlet 12. A plurality of heat exchangers 2 are arranged in the grey water flow path. The heat exchangers each comprises a grey water tube with a outer tube defining an annular space around the grey water tubes, as will be discussed in more detail in the following. A separator 3 is arranged upstream of the heat exchangers, and is arranged to separate the grey water from the source inlet 11 into a plurality of parallel sub-paths, each leading through one of the plurality of heat exchangers 2. A collector 4 is arranged downstream of the heat exchangers 2, and is arranged to reassemble the grey water from the sub-paths into a single flow path.

A fresh water stream, provided in the form of a fresh water flow path 5 is lead into the heat exchangers, within the annular spaces around the grey water tubes, and is lead in a direction being opposite to the flow direction of the grey water.

The heat recovery apparatus may further comprise a controller 6. The controller may be connected to a first temperature sensor 61 in the fresh water stream going into the heat exchangers, and a second temperature sensor 62 in the fresh water stream going out from the heat exchangers. The controller may further be connected to a valve 62 arranged in the fresh water stream going through the heat exchangers. The controller is hereby arranged to control the flow rate of fresh water going through the heat exchangers. The valve 62 may e.g. be arranged in the fresh water stream downstream from the heat exchangers, as in the illustrative example. However, the valve may also be arranged upstream of the heat exchangers. The controller may further be connected to a valve 64 controlling a flow rate of fresh water bypassing the heat exchangers.

In the illustrative example of FIG. 1, grey water from e.g. showers, e.g. having a temperature of 39 deg. C., may enter into the source inlet 11. The grey water flows through the grey water stream, through the heat exchangers, and exits into the drain outlet 12. Fresh water having e.g. a temperature of 7 deg. C. is lead into the heat exchangers 2, and the heat recovery in the heat exchangers may heat the fresh water to a temperature in the range of 18-24 deg. C., depending on the flow rate. In case a low flow rate is used, such as a flow rate corresponding to the flow rate of the grey water, a higher output temperature may be obtained, such as 24 deg. C., but with a somewhat lower heat recovery efficiency. If a higher fresh water flow rate is used, such as double the flow rate of the grey water, a somewhat lower output temperature will be achieved, such as 18 deg. C., but with a higher heat recovery efficiency. The fresh water heated at the heat exchangers will then be forwarded to a heater 7, to heat the fresh water to a desired hot water temperature, such as 55 deg. C.

The heater 7 may be an electric heater. However, other heaters are also feasible, such as a district heating or heat network arrangement, using hot water from waste burning, burning of biomass, and the like.

Depending on the need for hot water, the controller may further control the valves 63 and 64 to control the flow rate of fresh water through the heat exchangers, and to control an addition of cold fresh water, bypassing the heat exchangers, into the heater 7.

Figure 2A:
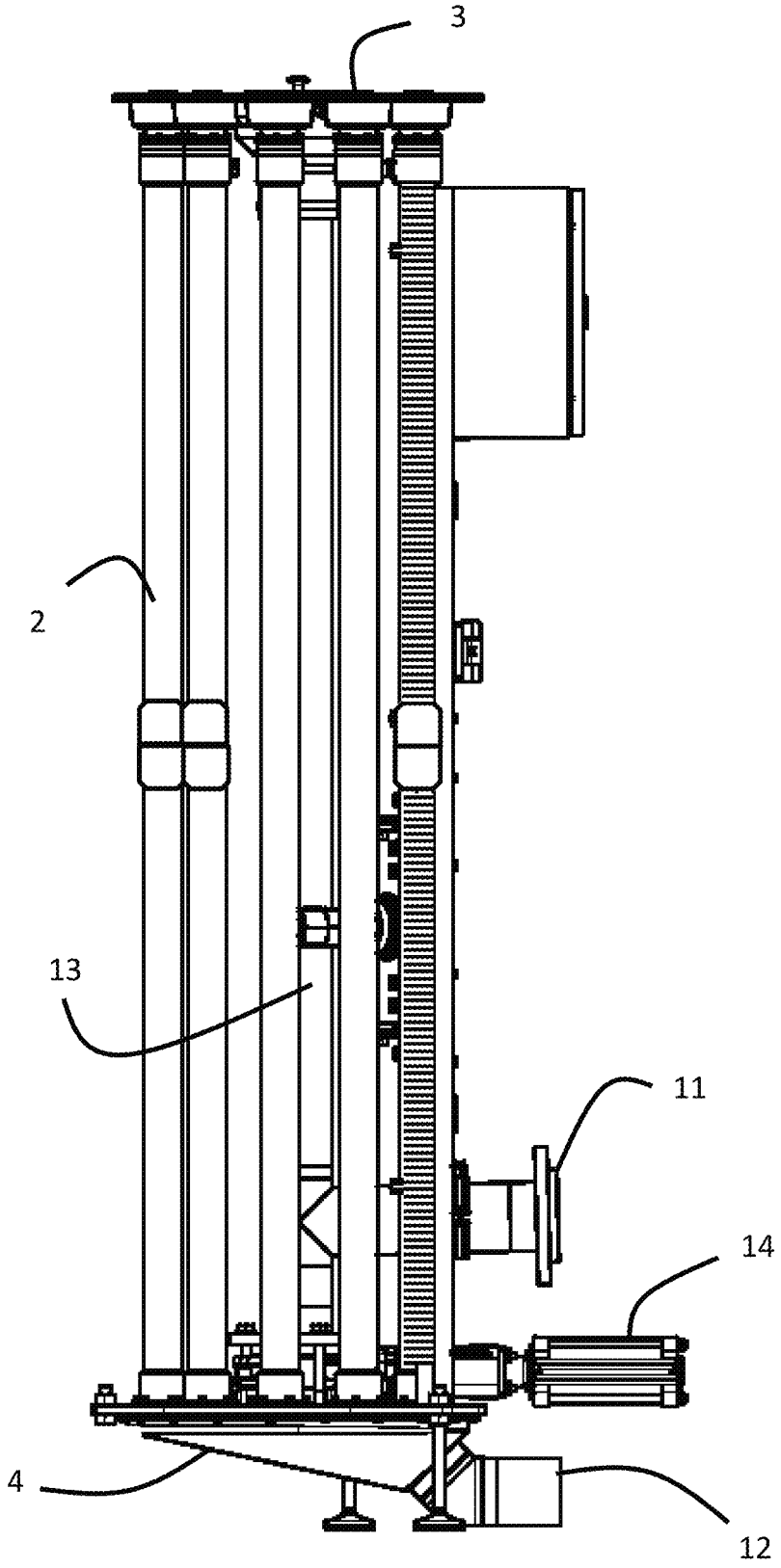
Figure 2B:
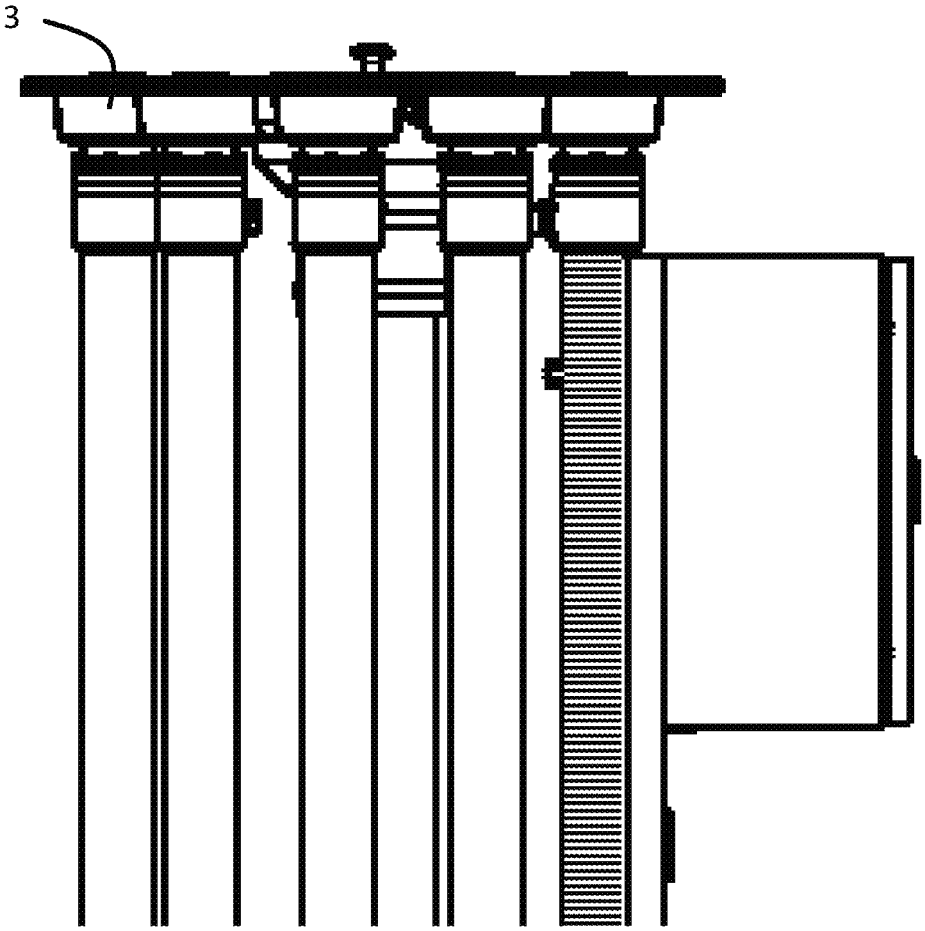
Figure 2C:
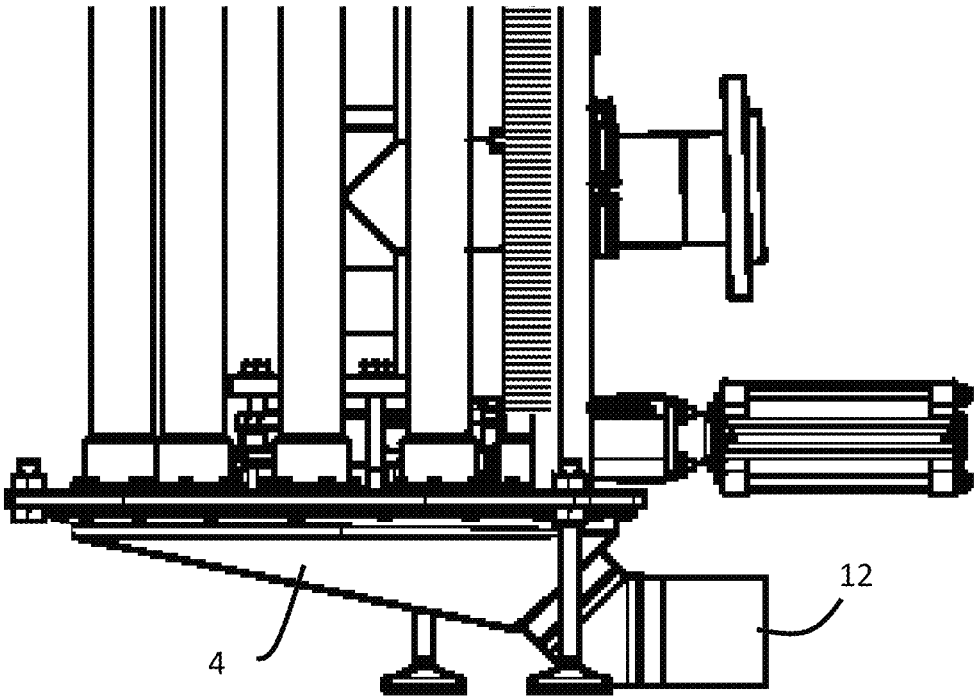

A more detailed discussion of an exemplary heat recovery apparatus will now be provided with reference to FIGS. 2*a-c*.

In this embodiment, grey water is assembled from the sources, such as the drains of showers, and is lead through a grey water flow path 1 leading from the source inlet 11 to a drain outlet 12. A plurality of heat exchangers 2 are arranged in the grey water flow path. A separator 3 is arranged upstream of the heat exchangers, and is arranged to separate the grey water from the source inlet 11 into a plurality of parallel sub-paths, each leading through one of the plurality of heat exchangers 2. A collector 4 is arranged downstream of the heat exchangers 2, and is arranged to reassemble the grey water from the sub-paths into a single flow path.

In this embodiment, the source inlet for the grey water is arranged at a low position, close to the collector 4, and is led through a grey water feeding tube 13 extending from a position in the vicinity of the collector to the separator. Hereby, the grey water is led from the inlet 11 close to the collector, and then up through the grey water feeding tube 13, and into the separator 3. Thus, the grey water here extends essentially vertically, and the grey water flows upwardly through the grey water feeding tube 13.

Beneath the inlet 11, the grey water feeding tube 13 may be connected to the collector. This part of the tube is normally closed during ordinary use, but may be opened occasionally for cleaning and the like. Since the grey water preferably flows upwardly through the grey water feeding tube, particles and other solid or semi-solid waste in the grey water will, at least to some extent, sediment to the bottom of the grey water feeding tube, beneath the inlet opening, where it can easily be removed from time to time. To this end, an openable valve 14 may e.g. be arranged in the grey water feeding tube at a position in the vicinity of the collector. The openable valve 14 may e.g. be in the form of a gate valve or sluice valve, that opens by retracting a barrier, gate, out of the path of the fluid. The gate may have a uniform thickness, but is preferably wedge shaped. By opening the valve, the liquid in the grey water feeding tube, above the valve, will due to gravity flow downwardly through the valve and into the collector 4, thereby bringing along all the solid and semi-solid waste that may have assembled at the bottom of the grey water feeding tube. Thus, cleaning becomes very simple, since it only involves opening of the valve from time to time, such as periodically, at given time intervals, or when a sensor or the like detects a need for cleaning.

The grey water feeding tube may also comprise a sieve (not shown), arranged e.g. above the inlet 11 but close to the collector, or higher, at an intermediate position between the collector and the separator. The sieve will also be cleaned as grey water is flowing downwards when the valve is opened. The sieve may e.g. comprise a mesh, such as a wire mesh, or a plate with perforations, e.g. made of metal or plastic material.

The grey water feeding tube 13 is here arranged centrally within the plurality of heat exchangers 2, with the plurality of heat exchangers preferably being arranged evenly distributed around the grey water feeding tube.

Figure 4:
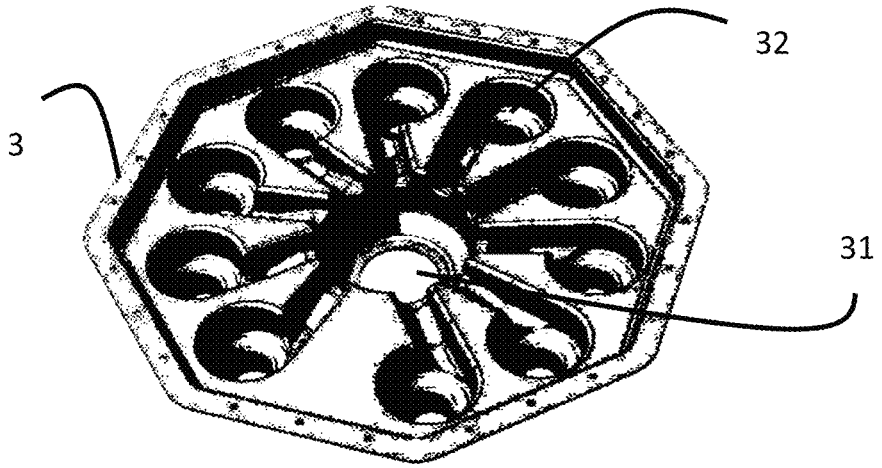
FIG. 4 is a perspective view of a separator of the grey water heat recovery apparatus of FIG. 2*a;*

The separator 3 is arranged to separate the grey water into the different heat exchangers 2. The upper part of the heat recovery apparatus, including the separator, is illustrated in more detail in FIG. 2*b*, and the separator is also shown in FIG. 4.

The separator 3 is here formed as a tray, with a central opening connected to the grey water feeding tube 13, to form a separator inlet 31. The separator inlet 31 leads into a plurality of vortex generating outlets 32 connected to the heat exchangers, to form sub-paths for the grey water through the plurality of heat exchangers.

In this embodiment, separator inlet is centrally arranged in the separator, and the vortex generating outlets are arranged distributed, and preferably evenly distributed, around the separator inlet. The number of vortex generating outlets corresponds to the number of sub-paths. In a preferred embodiment, the number of sub-paths is more than 2, such as at least three, at least 5, at least 7 or even 10 or more. The number of sub-paths, and heat exchangers, may be in the range of 3-15, and preferably 5-12, and most preferably 7-10. In the illustrative example, 10 sub-paths and vortex generating outlets 32 are provided.

The vortex generating outlets may comprise an inlet channel and a circular cup centered around the outlet connected to the sub-paths. The channels debouche off-center into the circular cups. The channels may e.g. debouche close to the rim of the circular cup. Preferably, the channels debouche in a direction essentially tangential with a wall of the circular cup. Further, the circular cups may have a bottom with slanting sides towards the outlet opening.

Due to the vortex generating outlets, the grey water entering into the heat exchangers will not only have a longitudinal flow, but also a rotational flow around the longitudinal direction. This will create turbulence and a greater exposure of the grey water to the walls of the heat exchangers, which increases the heat recovery efficiency.

Figure 3A:
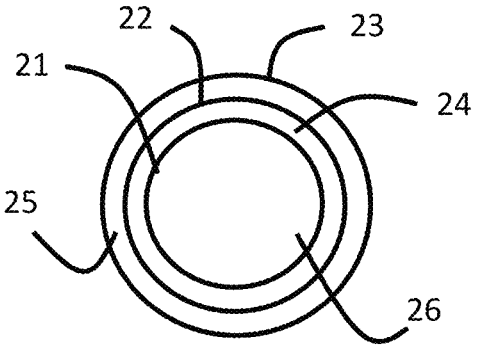
FIGS. 3*a-b* are illustrations of a heat exchanger of the grey water heat recovery apparatus of FIG. 2*a*, where

The heat exchangers 2 comprises double or triple wall tubes. In one embodiment, the grey water flows in an inner tube, and fresh water in an outer tube defining an annular space around the grey water tubes. However, in a preferred embodiment an inner tube is arranged inside the grey water tube. This tube may e.g. be air filled. In such an embodiment, as illustrated in FIG. 3*a*, an inner wall 21 defines an inner tube 26 and an inner cavity, which may be empty. An intermediate wall 22, arranged concentrically around the inner wall, defines a second tube and a first annular cavity 24, through which the grey water is led. An outer wall 23 arranged concentrically around the intermediate wall defines a third tube and a second annular cavity 25, through which the fresh water is led.

The fresh water is led through the annular spaces around the grey water tubes, and is lead in a direction being opposite to the flow direction of the grey water.

The annular space for the fresh water around each grey water tube preferably extends essentially over the entire length of the grey water tube, from the separator to the collector. This increases the contact area and makes the heat recovery more efficient. However, the annular space for the fresh water may also be provided over only a part of the grey water tubes.

In a preferred embodiment, the grey water tubes extend in a generally vertical direction. Thus, the grey water is moved downwardly through the grey water tubes.

The wall 22 of the grey water tube forms a separation between the grey water and the fresh water, thereby prohibiting contact between the grey water and the fresh water. The wall 22 of the grey water tube is preferably made of a material with high thermal conductivity. In a preferred embodiment, the wall of the grey water tube is made of copper. However, in order to make the material less sensitive to chemicals, such as chloride, that may be present in the grey water and/or the fresh water, the wall material may be coated, e.g. with chrome, to be more resistant. In a preferred embodiment, such a coating is provided on both sides of the wall, i.e. both towards the grey water and towards the fresh water. However, in alternative embodiments, such a coating may be provided only at one side, such as towards the grey water.

Figure 7A:
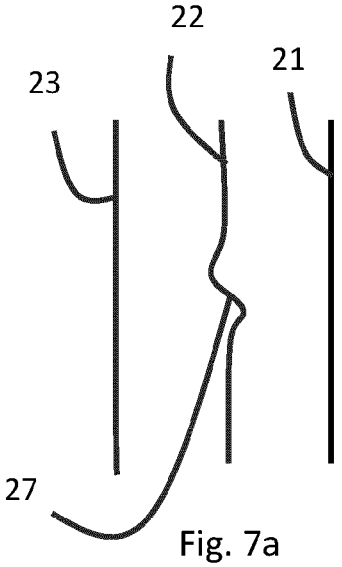
FIGS. 7*a-c* are schematic illustrations of various turbulence inducing arrangements for a heat exchanger in accordance with embodiments of the present invention.

In an embodiment, the wall of the grey water tube may be provided with baffles, such as inward protrusions, extending in towards either the grey water or the fresh water, or both. In FIG. 7*a*, such an embodiment is illustrated. Here, protrusions 27, forming the baffles, are provided in the intermediate wall 22, extending both into the annular space leading the grey water and the annular space leading the fresh water.

Figure 7B:
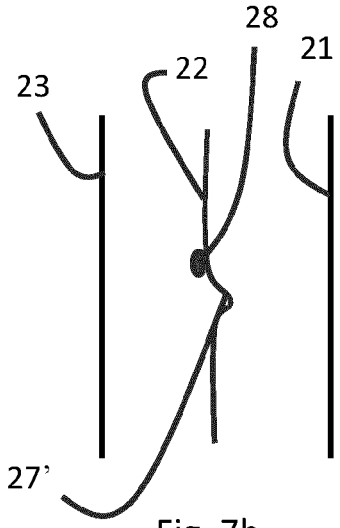

In an alternative embodiment, the inward protrusions 27' only extend towards one of the sides, such as into the grey water side, as shown in FIG. 7*b*.

The inward protrusions may be formed as corrugations, forming a ridge or rib towards one side and a corresponding groove on the other side. The inward protrusions may be formed as crimped formations in the tube wall.

Figure 7C:
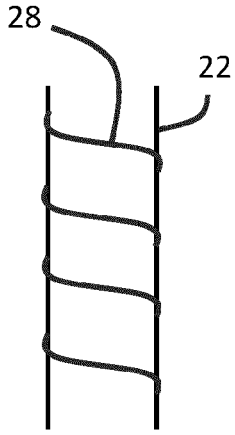

At one or both of the sides, and in particular on the side towards the fresh water, inward protrusions may also be provided in the form of one or more wire(s) 28, e.g. arranged in a helical path, as a thread, and extending into the cavity where the fresh water, or grey water, flows, as illustrated in FIGS. 7*b* and 7*c*. The wires may be made of a heat conductive material, and having a thickness or diameter arranged to only span partway in the radial direction of the annular space.

The inward protrusions, baffles or wire only extend partly into the cavity, and do not extend into the other side of the tube. Thus, the inward protrusions, baffles and wires do not stop the grey water and/or fresh water in any direction, and still allows it to flow generally in an axial, longitudinal direction, but at the same time increase the turbulence as the grey water and/or fresh water flows over the inward protrusions/baffles.

The inward protrusions, baffles and/or wires may extend generally in a radial direction, e.g. as circles extending around the wall. However, the inward protrusions, baffles or wires may also be arranged in a helical form, such as in the form of threads, as illustrated in FIG. 7*c*.

The increased turbulence in the grey water and/or the fresh water makes the heat transfer to the fresh water more efficient, and consequently increases the heat recovery efficiency. The increased turbulence disrupts the boundary layer and encourage mixing of the flow so that a greater volume of the flow comes into direct contact with the wall, for optimal heat transfer efficiency.

The wire(s) 28 may extend generally in a radial direction, e.g. as circles extending around the wall. However, the wire(s) 28 may also be arranged in a helical form, such as in the form of threads. In a preferred embodiment, at least two wires, and preferably at least three wires, are arranged in corresponding, parallel, helical shapes. Hereby, the same effect of generated turbulence can be achieved, but with a higher pitch for the threads. This is particularly of advantage when e.g. combined with the above discussed baffles, since it alleviates the problem of the wires sinking into the baffles. However, the plurality of wires may also be arranged with different pitch, or even being arranged in opposite directions, so that the wires occasionally cross each other, e.g. in a crosswise intersecting manner.

Figure 3B:
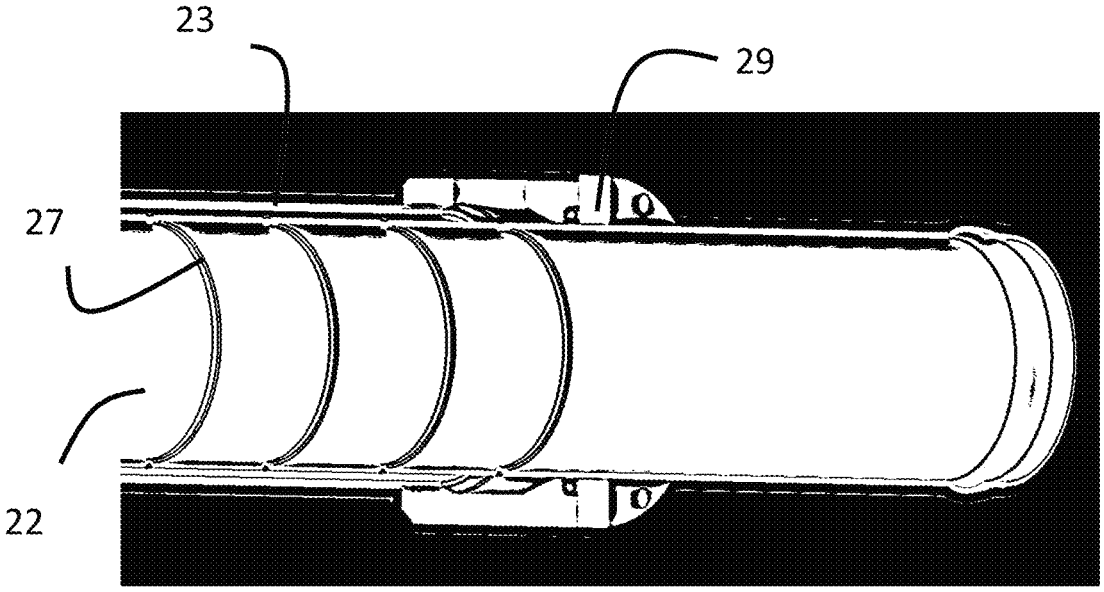

Preferably, a plurality of baffles 27 are provided, and arranged after each other and a distance from each other, along the length of the tube, as illustrated in more detail in FIG. 3*b*. The baffles may be arranged with the same separation distance between each other.

In an embodiment, as shown in FIG. 3*b*, the baffles are in the form of inward protrusions, forming ribs or ridges extending partly into the cavity through which the grey water flows, to create turbulence in the grey water. Further, wires 28 are preferably arranged on the same wall, and on the opposite side, i.e. the side facing the fresh water, in order to create turbulence in the fresh water. The wires may be arranged in a helical patent, whereas the inward protrusions may be arranged annular ribs/ridges extending essentially perpendicularly to the longitudinal direction of the tube.

The baffles provide an increased surface area between the grey water and the fresh water, and also avoids forming of a boundary layer along the tube wall, and ensures that a greater volume of the fluids come into contact with the tube wall.

The annular cavity 25 forming the pathway for the fresh water is preferably closed at a top and bottom position over the intermediate tube 22. For example, the outer tube 23 may end with a fitting 29 forming a sealed connection to the intermediate tube 22. The fitting may also have an inlet connecting the fitting to an inlet or outlet for the freshwater.

Figure 2D:
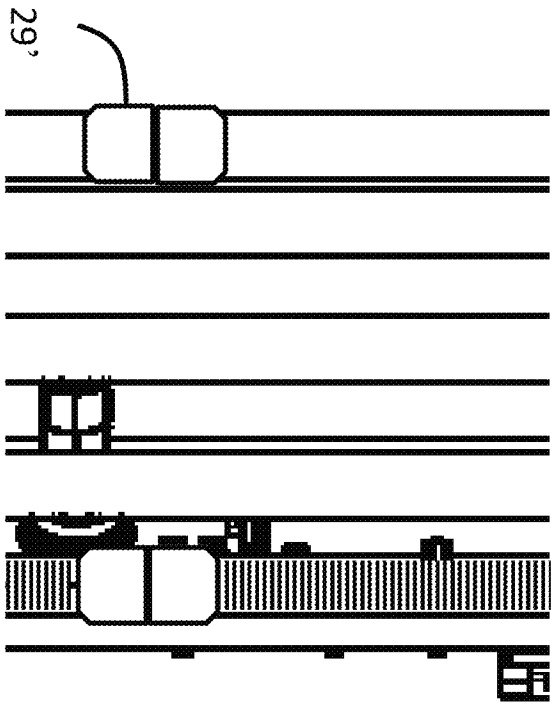

The heat exchangers are preferably relatively long, such as having a length in the range of 1-5 m, and preferably in the range of 2-4 m. The length is preferably adapted to the height of the room in which the heat exchangers are arranged. On the other hand, the heat exchangers are preferably as long as possible, thereby increasing the heat recovery efficiency. When long heat exchangers are used, each heat exchanger may be formed by at least two sections, the sections being connected together by a connection device, such as a fitting 29', enabling flow for both the grey water and the fresh water, as best seen in FIG. 2*d*. The connection device may e.g. form a connection between the inner tube wall(s), thereby allowing a flow through the inner tube, or the inner annular cavity, through which the grey water flows. One or more of the outer annular cavities, and in particular the outer annular cavity leading the freshwater, may be closed by the connection device, and instead connected together by a bypass connection. Such connection devices are per se known e.g. from US 2015/0130183 and U.S. Pat. No. 8,991,871, said documents hereby being incorporated by reference in their entirety.

Figure 5:
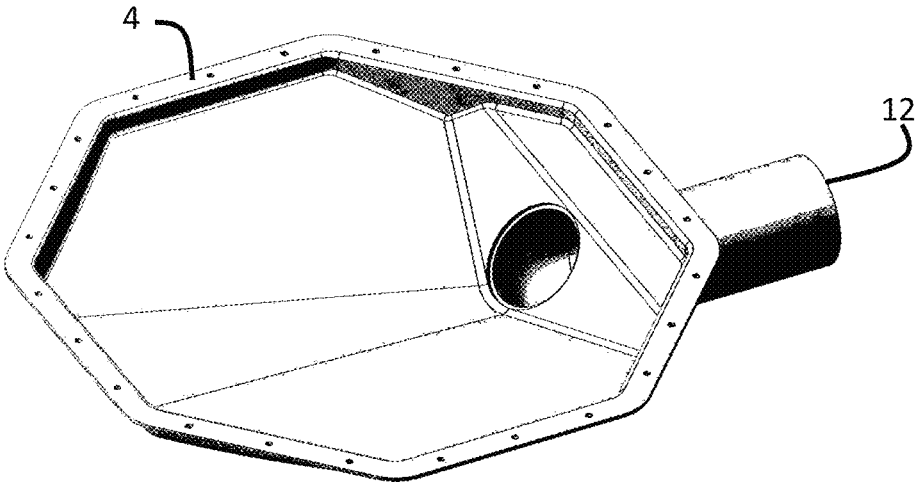
FIG. 5 is a perspective view of a collector of the grey water heat recovery apparatus of FIG. 2*a;*

Below the heat exchangers, the tubes leading the grey water opens into a collector 4, as best seen in FIG. 2*c* and FIG. 5. The collector may be formed as a bowl or tray, and preferably having a bottom sloping downwardly into a bottom outlet leading into the drain outlet 12. Thus, the collector 4 serves to rejoin the grey water that has been separated by the separator 3, and led in sub-paths through the heat exchangers, into a common path leading into the drain outlet 12.

Figure 6:
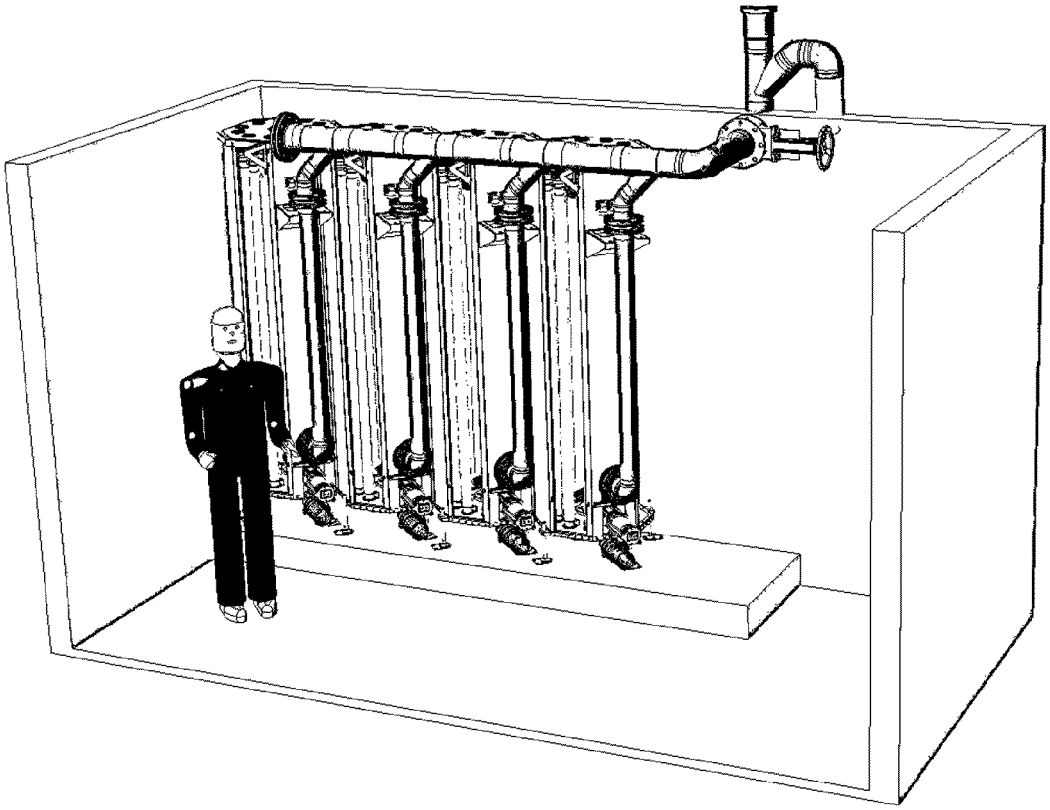
FIG. 6 is a perspective view from the side of a heat recovery system comprising a plurality of grey water heat recovery apparatuses in accordance with embodiments of the present invention.

The heat recovery apparatus may be used together with other heat recovery apparatuses of the same type in a heat recovery system comprising a plurality of such heat recovery apparatuses. The system may e.g. comprise 2, 3, 4, 5 or even more heat recovery apparatuses. Such a heat recovery system is illustrated in FIG. 6. The system here comprises four heat recovery apparatuses. The heat recovery apparatuses are preferably arranged in parallel, allowing the flow of grey water first to be separated between the different heat recovery apparatuses, and then, as discussed in the forgoing, be separated between the different heat exchangers within each heat recovery apparatus. This increases the heat recovery efficiency even further, in particular when the flow rate and volume of grey water is high.

Specific embodiments of the invention have now been described. However, several alternatives are possible, as would be apparent for someone skilled in the art. For example, more or fewer heat exchangers may be used in each heat recovery apparatus. Further, even though the heat exchangers discussed in the foregoing have been discussed as having a generally vertical orientation, the heat exchangers may alternatively be inclined, forming an angle towards the vertical direction, or even be horizontally oriented. Further, the baffles may be formed in other ways than by inward protrusions and wires, and may also even be omitted.

Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

The invention claimed is:

1. A grey water heat recovery apparatus in which heat is transferred between a grey water stream and a fresh water stream, wherein the apparatus comprises:

a grey water flow path leading from a source inlet to a drain outlet;

a plurality of heat exchangers arranged in said grey water flow path;

a separator arranged upstream of said heat exchangers, arranged to separate grey water from the source inlet into a plurality of parallel sub-paths, each sub-path being lead to one of said plurality of heat exchangers;

a collector arranged downstream of said heat exchangers, arranged to reassemble the grey water from the sub-paths into a single flow path;

wherein each heat exchanger comprises a grey water tube extending in a generally vertical direction from the separator to the collector, and an outer tube surrounding at least a part of the grey water tube, the outer tube defining an annular space around the grey water tube; and a fresh water flow path formed within the annular spaces around the grey water tubes in said heat exchangers in a flow direction being opposite to the flow direction of the grey water, wherein the separator comprises a separator inlet leading into a plurality of vortex generating outlets connected to said sub-paths, said vortex generating outlets arranged distributed around said separator inlet.

2. The heat recovery apparatus of claim 1, wherein each vortex generating outlet comprises an inlet channel and a circular cup centered around the outlet connected to the sub-paths, wherein the channel debouches off-center into the circular cup.

3. The heat recovery apparatus of claim 2, wherein the channel debouches in a direction essentially tangential with a wall of the circular cup.

4. The heat recovery apparatus of claim 1, wherein the annular space around each grey water tube extends essentially over the entire length of the grey water tube, from the separator to the collector.

5. The heat recovery apparatus of claim 1, further comprising a grey water feeding tube extending from a position in the vicinity of the collector to the separator.

6. The heat recovery apparatus of claim 5, wherein the grey water feeding tube is arranged centrally within the plurality of heat exchangers.

7. The heat recovery apparatus of claim 6, further comprising an openable valve arranged in the grey water feeding tube at a position in the vicinity of the collector.

8. The heat recovery apparatus of claim 7, wherein the plurality of heat exchangers are arranged evenly distributed around the grey water feeding tube.

9. The heat recovery apparatus of claim 1, wherein, in each of the heat exchangers, a wall of the grey water tube is provided with baffles.

10. The heat recovery apparatus claim 1, wherein, in each of the heat exchangers, a wall of the grey water tube facing the annular space is provided with at least one wire arranged as a thread protruding into the annular space.

11. The heat recovery apparatus of claim 1, wherein each heat exchanger further comprises an inner tube, arranged inside the grey water tube, the intermediate space formed between the inner tube and the grey water tube forming the grey water sub-path.

12. The heat recovery apparatus of claim 11, wherein, the baffles are in the form of inward protrusions extending into the grey water tube.

13. The heat recovery apparatus of claim 1, wherein each heat exchanger is formed by at least two sections, the sections being connected together by a connection device enabling flow for both the grey water and the fresh water.

14. A heat recovery system comprising a plurality of heat recovery apparatuses in accordance with claim 1.

15. The heat recovery apparatus of claim 1, wherein the vortex generating outlets are arranged evenly distributed around said separator inlet.

16. The heat recovery apparatus of claim 1, wherein the separator is formed as a tray, wherein the separator inlet is arranged at the bottom of the tray.

* * * * *